US008991976B2

(12) United States Patent
Uchiyama

(10) Patent No.: US 8,991,976 B2
(45) Date of Patent: Mar. 31, 2015

(54) METHOD OF MANUFACTURING WATER REPELLENT FILM, NOZZLE PLATE, INKJET HEAD, AND INKJET RECORDING DEVICE

(71) Applicant: FUJIFILM Corporation, Tokyo (JP)

(72) Inventor: Hiroki Uchiyama, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/172,614

(22) Filed: Feb. 4, 2014

(65) Prior Publication Data

US 2014/0307030 A1 Oct. 16, 2014

(30) Foreign Application Priority Data

Feb. 4, 2013 (JP) ..... 2013-019438
Jan. 6, 2014 (JP) ..... 2014-000262

(51) Int. Cl.
*B41J 2/135* (2006.01)
*B41J 2/14* (2006.01)
*B41J 2/16* (2006.01)

(52) U.S. Cl.
CPC ..... *B41J 2/1433* (2013.01); *B41J 2/1642* (2013.01); *B41J 2/1606* (2013.01)
USPC ..... 347/45; 347/44; 347/47; 347/68

(58) Field of Classification Search
CPC ..... B41J 2/1433; B41J 2/1642; B41J 2/1606
USPC ..... 347/20, 44, 45, 47, 68, 70, 72
See application file for complete search history.

(56) References Cited

U.S. PATENT DOCUMENTS 7,883,179 B2 * 2/2011 Cha et al. ..... 347/45
8,128,201 B2 3/2012 Okamura et al.
8,226,208 B2 7/2012 Okamura et al.
8,523,322 B2 9/2013 Okamura et al.

FOREIGN PATENT DOCUMENTS

JP 40-6171094 A * 6/1994 ..... 347/45

* cited by examiner

*Primary Examiner* — Juanita D Jackson
(74) *Attorney, Agent, or Firm* — Studebaker & Brackett PC

(57) ABSTRACT

An object is to provide a method of manufacturing a water repellent film, a nozzle plate, an inkjet head, and an inkjet recording device which are able to improve dynamic water repellency of a water repellent film which includes a straight-chain fluorine-based organic material. The method of manufacturing a water repellent film includes forming a first organic film on a silicon substrate with a silicon compound which does not include a fluorine atom as a raw material, forming an inorganic oxide film on the first organic film, and forming a second organic film on the inorganic oxide film with a straight-chain fluorine-containing silane coupling agent as a raw material.

19 Claims, 3 Drawing Sheets

METHOD OF MANUFACTURING WATER REPELLENT FILM, NOZZLE PLATE, INKJET HEAD, AND INKJET RECORDING DEVICE

BACKGROUND OF THE INVENTION

1. Field of the Invention

The present invention relates to a method of manufacturing a water repellent film, a nozzle plate, an inkjet head, and an inkjet recording device and, in particular, relates to a technique for a water repellent film which includes a straight-chain fluorine-containing silane coupling agent.

2. Description of the Related Art

When ink is attached to the surface of a nozzle plate in inkjet heads which are used in inkjet recording devices, this has an influence on ink droplets which are discharged from the nozzles and variations may occur in the discharge direction of the ink droplets. When there is variation in the discharge direction of the ink droplets, it is difficult to land the ink droplets at a predetermined position on a recording medium, which is a factor which deteriorates image quality.

For this reason, by forming a water repellent film on a nozzle plate surface, ink is prevented from attaching to the nozzle plate surface and the discharge performance is improved. For example, JP2008-544852A discloses a fluid ejector which has a non-wetting monolayer so as to cover at least a portion of an external surface of the fluid ejector and to surround an orifice of the fluid ejector.

In addition, JP2010-511533A discloses a liquid discharging device which has a first surface, a second surface, and an orifice which is able to discharge a liquid which comes into contact with the second surface. JP2010-511533A discloses that there is a non-wettable layer, which is exposed on at least the first surface of the liquid discharging device, and a protective layer which is exposed on the second surface, where the protective layer is more wettable than the non-wettable layer.

In JP2008-544852A and JP2010-511533A, FOTS (tridecafluoro-1,1,2,2-tetrahydrooctyltrichlorosilane) which is a FAS (fluoroalkyl silane) based material, and 1H,1H,2H,2H-perfluorodecyltrichlorosilane (FDTS) are used as precursors for forming a non-wettable layer.

SUMMARY OF THE INVENTION

The straight-chain fluorine-containing silane coupling agent which is the FAS based material which is applied in JP2008-544852A and JP2010-511533A has excellent static water repellency and also has a molecular weight which is suitable for a gas phase method.

However, it is known that it is difficult for liquid droplets to fall on top of the straight-chain fluorine-containing silane coupling agent (falling angle=high sliding down angle), in other words, that the dynamic water repellency is deteriorated. Therefore, residue traces such as liquid remnants or coffee stains remain on the nozzle plate surface. These accelerate the deterioration of a water repellent film, cause residue attachment or clogging of the ink droplets or the like in the vicinity of the nozzles, and have a significant influence on the discharge performance of the inkjet heads.

In order to improve the dynamic water repellency, it is also possible to use a material which includes an ether group instead of the straight-chain fluorine-containing silane coupling agent. However, since the material which includes the ether group has a large molecular weight, it is necessary to perform evaporation by applying a high heat to the material. As a result, material where the material structure is destroyed is attached to the nozzle plate surface and the uniformity of the water repellent film decreases.

The present invention is made in consideration of the above circumstances and has an object of providing a method of manufacturing a water repellent film which includes a straight-chain fluorine-containing silane coupling agent which has excellent dynamic water repellency, a nozzle plate, an inkjet head, and an inkjet recording device.

A method of manufacturing a water repellent film of the present invention includes forming a first organic film on a silicon substrate by using a silicon compound represented by $X_{3-n}R^2_nSi—R^1—Z$ (n=0, 1, 2) which does not include a fluorine atom or a silicon compound represented by $HN(SiR^3R^4R^5)_2$, as a raw material, forming an inorganic oxide film on the first organic film, and forming a second organic film on the inorganic oxide film by using a straight-chain fluorine-containing silane coupling agent as a raw material.

However, X in the formula is any of a halogen (except fluorine), a methoxy group, an ethoxy group, an acetoxy group, or a 2-methoxyethoxy group, $R^2$ is an alkyl group which has 1 to 3 carbon atoms, $R^1$ is $C_mH_{2m}$ (m is a natural number of 1 to 20), Z is a group which contains any of a methyl group, a vinyl group, an amino group, an epoxy group, a methacrylic group, an acrylic group, a mercapto group, an isocyanate group, an acylthio group, or a ureido group, and $R^3$, $R^4$, and $R^5$ are alkyl groups which have 1 to 3 carbon atoms.

Preferably, the silicon compound has a boiling point of 20° C. to 350° C.

Preferably, the straight-chain fluorine-containing silane coupling agent is a compound which is represented by $X_{3-n}R^7_nSi—R^6—Z$ (n=0, 1, 2).

Here, X in the formula is any of a halogen, a methoxy group, an ethoxy group, an acetoxy group, or a 2-methoxyethoxy group, $R^7$ is an alkyl group which has 1 to 3 carbon atoms, $R^6$ is a $C_pH_{2p}$ group (p is a natural number of 1 to 20) or a group which includes a straight-chain fluorocarbon chain and $C_qH_{2q}$ (q is a natural number of 1 to 20), and Z is a group which contains any of a methyl group, a vinyl group, an amino group, an epoxy group, a methacrylic group, an acrylic group, a mercapto group, an isocyanate group, an acylthio group, a ureido group, and a trifluoromethyl group.

Preferably, at least one of the first organic film and the second organic film is a self-assembled monolayer.

Preferably, in the forming of the first organic film, the first organic film is formed by a gas phase method.

Preferably, the inorganic oxide film is a silicon oxide film.

Preferably, in the forming of the inorganic oxide film, the inorganic oxide film is formed by a gas phase method.

Preferably, in the forming of the second organic film, the second organic film is formed by a gas phase method.

A nozzle plate of the present invention is provided with a silicon substrate where nozzles are formed, a first organic film which is formed on the silicon substrate and which does not include fluorine atoms, an inorganic oxide film which is formed on the first organic film, and a second organic film which is formed on the inorganic oxide film and of which a raw material is a straight-chain fluorine-containing silane coupling agent, where in a case where pure water is applied onto the second organic film and the silicon substrate is inclined, an end section where the pure water and the second organic film come into contact moves 1 mm or more with the angle of the silicon substrate at 90°.

A nozzle plate of the present invention is provided with a silicon substrate where nozzles are formed, a first organic film which is formed on the silicon substrate and which does not include fluorine atoms, an inorganic oxide film which is formed on the first organic film, and a second organic film which is formed on the inorganic oxide film and of which a raw material is a straight-chain fluorine-containing silane coupling agent, where in a case where pure water is applied onto the second organic film and the silicon substrate is inclined, an end section where the pure water and the second organic film come into contact moves 1 mm or more with the angle of the silicon substrate at 60°.

An inkjet head of the present invention is provided with the nozzle plate described above, a pressure chamber which is linked with the nozzle, and a piezoelectric element which pressurizes a liquid inside a pressure chamber according to a driving signal.

An inkjet recording device of the present invention is provided with the inkjet head described above.

According to the present invention, it is possible to improve the dynamic water repellency of the water repellent film which includes a straight-chain fluorine-containing silane coupling agent.

DESCRIPTION OF THE PREFERRED EMBODIMENTS

Figure 1:
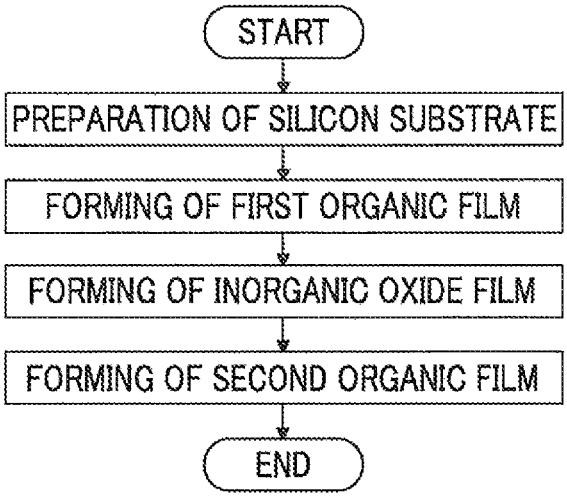
FIG. 1 is a flowchart which shows a film forming method of a water repellent film.

Below, description will be given of preferable embodiments of the present invention with reference to the accompanying drawings. The present invention will be described using the following preferable embodiments; however, it is possible to make changes using a large number of techniques without departing from the range of the present invention, and it is possible to use other embodiments than the present embodiments. Accordingly, all changes within the range of the present invention are included in the range of the scope of the claims.

Here, in the drawings, portions which are indicated by the same reference numerals are the same elements which have the same functions. In addition, in the present specification, in a case where a numerical range is represented using "A to B", the numerical values of the upper limit and the lower limit which are represented by "A to B" are included in the numerical range.

Below, detailed description will be given of preferable embodiments of the present invention with reference to the accompanying drawings.

FIG. 1 is a flowchart which shows a method of manufacturing a water repellent film in the present embodiment.

Step S1

Firstly, the silicon substrate is prepared. Here, in the present embodiment, description will be given with a nozzle plate of an inkjet head, which is used in an inkjet recording device as an example.

The silicon substrate which configures the nozzle plate may be provided with nozzles in advance, or nozzle holes may be provided after the water repellent film is formed on the silicon substrate. The method of manufacturing a nozzle plate includes a nozzle forming step. In particular, by using the silicon substrate, it is possible to use a semiconductor process, and it is possible to form fine nozzles at a high density with high precision.

Step S2

The first organic film which does not include fluorine is formed on the silicon substrate. By forming the first organic film, it is possible to improve the dynamic water repellency of a second organic film which is formed on an upper layer.

The first organic film is formed with a silicon compound represented by $X_{3-n}R^2_nSi—R^1—Z$ (n=0, 1, 2) which does not include a fluorine atom or a silicon compound represented by $HN(SiR^3R^4R^5)_2$, as a raw material. Here, X is any of a halogen (except fluorine), a methoxy group, an ethoxy group, an acetoxy group, or a 2-methoxyethoxy group, and $R^2$ is an alkyl group which has 1 to 3 carbon atoms, preferably a methyl group. R' is $C_mH_{2m}$ (m is a natural number of 1 to 20), Z is a group which includes any of a methyl group, a vinyl group, an amino group, an epoxy group, a methacrylic group, an acrylic group, a mercapto group, an isocyanate group, an acylthio group, and a ureido group, and the amino group may have a phenyl group or an alkylidene group. In addition, $R^3$, $R^4$, and $R^5$ are alkyl groups which have 1 to 3 carbon atoms.

As a specific example, it is possible to use the following silicon compounds as raw materials. As silane monomers, it is possible to use n-octyl triethoxysilane: $CH_3(CH_2)_7Si(OCH_2CH_3)_3$, methyltriethoxysilane: $CH_3Si(OCH_2CH_3)_3$, methyltrimethoxysilane: $CH_3Si(OCH_3)_3$, or the like. As vinylsilane, it is possible to use vinyl triethoxysilane: $CH_2{=}CHSi(OCH_2CH_3)_3$, vinyl trimethoxysilane: $CH_2{=}CHSi(OCH_3)_3$, vinyl tris(2-methoxyethoxy)silane: $CH_2{=}CHSi(OCH_2CH_2OCH_3)_3$, vinylmethyldimethoxysilane: $CH_2{=}CHSiCH_3(OCH_3)_2$, or the like.

In addition, as epoxy silane, it is possible to use 2-(3,4-epoxycyclohexyl)ethyl trimethoxysilane (formula 1), 3-glycidoxypropyl trimethoxysilane (formula 2), 3-glycidoxypropyl triethoxysilane (formula 3), 3-glycidoxypropyl methyldimethoxysilane (formula 4), 3-glycidoxypropyl methyldiethoxysilane (formula 5), or the like.

[Chem. 1]

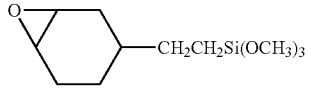

[Chem. 2]

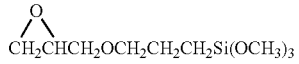

[Chem. 3]

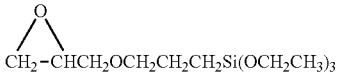

[Chem. 4]

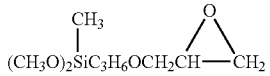

[Chem. 5]

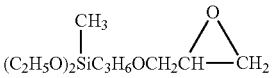

As methacrylic silane, it is possible to use 3-methacryloxypropyl triethoxysilane: $CH_2{=}C(CH_3)COOCH_2CH_2CH_2Si(OCH_2CH_3)_3$, 3-methacryloxypropyl trimethoxysilane: $CH_2{=}C(CH_3)COOCH_2CH_2CH_2Si(OCH_3)_3$, 3-methacryloxypropyl methyldimethoxysilane (formula 6), 3-methacryloxypropyl methyldiethoxysilane (formula 7), or the like.

[Chem. 6]

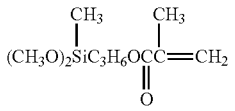

[Chem. 7]

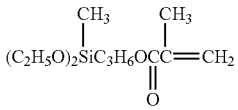

As acrylic silane, it is possible to use 3-acryloxypropyl trimethoxysilane (Formula 8) or the like

[Chem. 8]

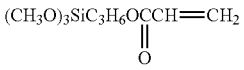

Examples of aminosilane include 3-aminopropyl triethoxysilane: $H_2NCH_2CH_2CH_2Si(OCH_2CH_3)_3$, 3-aminopropyl tri ethoxy silane: $H_2NCH_2CH_2CH_2Si(OCH_3)_3$, N-(2-aminoethyl)-3-aminopropyl trimethoxysilane: $H_2NCH_2CH_2NHCH_2CH_2CH_2Si(OCH_3)_3$, N-(2-aminoethyl)-3-aminopropyl methyldimethoxysilane: $H_2NCH_2CH_2NHCH_2CH_2CH_2SiCH_3(OCH_3)_2$, 3-(N-phenyl) aminopropyl trimethoxysilane (formula 9), 3-triethoxysilyl-N-(1,3-dimethyl-butylidene)propyl amine (formula 10), N-(vinylbenzyl)-2-aminoethyl-3-aminopropyl trimethoxysilane, or the like, and it is also possible to use hydrochlorides thereof.

[Chem. 9]

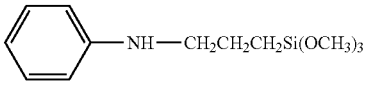

[Chem. 10]

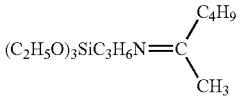

As ureidosilane, it is possible to use 3 ureidopropyl triethoxysilane (50% methanol solution) (Formula 11), or the like.

[Chem. 11]

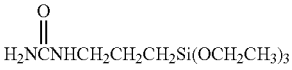

As mercapto and acylthio silane, it is possible to use 3-mercaptopropyl trimethoxysilane: $HSCH_2CH_2CH_2Si(OCH_3)_3$, 3-mercaptopropyl triethoxysilane $HSCH_2CH_2CH_2Si(OCH_2CH_3)_3$, 3-octanoylthio-1-propyl triethoxysilane: $CH_3(CH_2)_6C(=O)SCH_2CH_2CH_2Si(OCH_2CH_3)_3$, 3-mercapto propyli methyl dimethoxysilane (formula 12), or the like

[Chem. 12]

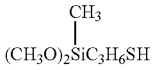

As isocyanate silane, it is possible to use 3-isocyanate propyl triethoxysilane: $O=C=NCH_2CH_2CH_2S(OCH_2CH_3)_3$, 3-isocyanate propyl trimethoxysilane: $O=C=NCH_2CH_2CH_2Si(OCH_3)_3$, or the like.

As alkyl silane, it is possible to use n-octyltrichlorosilane: $CH_3(CH_2)_7SiCl_3$, n-decyltrimethoxysilane: $CH_3(CH_2)_9Si(OCH_2CH_3)_3$, n-dodecyltrimethoxysilane: $CH_3(CH_2)_{11}Si(OCH_3)_3$, n-dodecyltrichlorosilane $CH_3(CH_2)_{11}SiCl_3$, n-hexadecyltrimethoxy silane: $CH_3(CH_2)_{15}Si(OCH_3)_3$, n-octadecyltrichlorosilane: $CH_3(CH_2)_{17}SiCl_3$, n-octadecyltrimethoxysilane: $CH_3(CH_2)_{17}Si(OCH_3)_3$, n-octadecyltriethoxysilane: $CH_3(CH_2)_{17}Si(OC_2H_5)_3$, n-eicosyltrichlorosilane $CH_3(CH_2)_{19}SiCl_3$, n-docosyltrichlorosilane: $CH_3(CH_2)_{21}SiCl_3$, n-nonadecenyltrichlorosilane: $CH_2=CH(CH_2)_{17}SiCl_3$, or the like.

As disilazane, it is possible to use 1,1,1,3,3,3-hexamethyldisilazane (HMDS).

As a method of forming the first organic film, it is possible to use a gas phase method such as a vacuum vapor deposition method or a CVD (Chemical Vapor Deposition) method as well as a liquid phase method where a solution of a silicon compound is coated onto a silicon substrate such as a dipping method, a spin coating method, a spray coating method, or a dispenser method.

In particular, a gas phase method is preferable in order to form the first organic film uniformly on complex structures seen on the nozzle plate.

In order to form the first organic film, for example, it is possible to use the YES-1224P CVD System of Yield Engineering Systems Inc.

It is preferable that an organic compound which has a boiling point of 20° C. to 350° C. be a raw material of the first organic film. By using the organic compound with a boiling point of 20° C. to 350° C. as a raw material, it is possible to form the first organic film without applying a high heat to the material, and it is possible to prevent the material structure of the raw material from being destroyed.

In addition, it is possible to form the first organic film with an organic compound which is represented by $C_aH_bZ_c$ (a, b: natural numbers of 5 or more, c: integer which includes 0, Z: includes any of O, N, or Si, or a combination of these) as a raw material.

The organic compound described above is an organic silicon compound, a cyclic hydrocarbon, or a straight-chain hydrocarbon. The cyclic hydrocarbon may be substituted or unsubstituted benzene. The substituted or unsubstituted benzene is $C_6H_{6-s}R^8_s$ (s=0, 1, 2, 3), $R^8$ is independently $—CH_3$, $—C_2H_5$, $—CH=CH_2$, or the like, and two or more types may be combined.

Examples of the substituted benzene described above include $C_6H_3(CH_3)_3$: 1,3,5-trimethylbenzene (TMB); boiling point of 165° C., $C_6H_4(CH_3)_2$: dimethyl benzene (o-xylene; boiling point of 144° C., or p-xylene; boiling point of 138° C.), $C_6H_5(CH=CH_2)$: vinyl benzene (styrene); boiling point of 145° C., or the like. In addition, for the cyclic hydrocarbons, other than the benzene derivatives, it is possible to use cyclohexane, cyclohexene, cyclohexadiene, cyclooctatetraene, and the like. As the straight-chain hydrocarbons, it is possible to use straight-chain alkanes: as $C_nH_{2(n+1)}$, pentane; boiling point: 36.1° C., isopentane; boiling point: 27.9° C., or neopentane; boiling point: 9.5° C., where n=5, hexane; boiling point: 68.7° C., where n=6, and the like. Other than these, it is possible to use straight-chain alkenes: as $C_nH_n$ (n=5), 1-pentene; boiling point: 30.0° C., as $C_nH_n$ (n=6), 1-hexene; boiling point of 63° C., or straight-chain alkynes: as $C_nH_{2(n-1)}$ (n=5), 1-pentyne; boiling point: 40.2° C., or the like.

As a method of forming the first organic film, it is possible to deposit an organic compound with a boiling point of 20° C. to 350° C. onto the silicon substrate using a gas phase method such as a capacitive coupling type plasma chemical vapor deposition method.

Preferably, the first organic film is a self-assembled monolayer, that is, the first organic film may be a single molecular layer. The thickness of the first organic film is 0.5 nm to 30 nm, preferably 0.5 nm to 10 nm, and more preferably 0.5 nm to 5 nm. Here, the self-assembled monolayer is a molecule film which is 1) a molecular aggregate which is formed when organic molecules are chemically adsorbed on a solid surface, and 2) a molecule film which is an aggregate and where molecular orientation and sequence regularity are significantly improved when forming a thin film in comparison with a molecular sequence state where a precursor molecule is in a liquid phase or a gas phase.

Step S3

An inorganic oxide film is formed on the first organic film. The inorganic oxide film is preferably a silicon oxide film. The inorganic oxide film promotes attachment to the second organic film. As a method of forming the inorganic oxide film, it is possible to use a gas phase method such as a vacuum vapor deposition method or a CVD method as well as a liquid phase method where a solution of a silicon compound is coated onto a silicon substrate such as a dipping method, a spin coating method, a spray coating method, or a dispenser method. In particular, a gas phase method is preferable in order to form the inorganic oxide film uniformly on complex structures seen on the nozzle plate.

For example, it is possible to form a silicon oxide film using a gas phase method by arranging a silicon substrate which is provided with the first organic film in a CVD chamber and introducing $SiCl_4$ and water vapor into the CVD chamber. For example, in order to form the inorganic oxide film, it is possible to use an MVD device manufactured by Applied MicroStructure, Inc. In addition, it is possible to form the silicon oxide film on the first organic film by sputtering.

The thickness of the inorganic oxide film is 5 nm to 100 nm, preferably 5 nm to 50 nm, and more preferably 5 nm to 30 nm.

Step S4

Finally, the second organic film is formed on the inorganic oxide film with the straight-chain fluorine-containing silane coupling agent as a raw material. The second organic film which is a liquid repelling film is, for example, formed by a dry process method such as a physical vapor deposition method (a vapor deposition method, a sputtering method, or the like) or a chemical vapor deposition method (a CVD method, an ALD method, or the like) which is a gas phase method, by a sol-gel method, or by a wet process method such as a coating method. For example, in order to form the second organic film, it is possible to use the MVD device manufactured by Applied MicroStructure, Inc.

As the straight-chain fluorine-containing silane coupling agent, a silicon compound which includes a carbon chain where one end terminates in a —$CF_3$ group and a second end terminates in a —$SiCl_3$ group is used. Examples of suitable silicon compounds which attach to the surface of the inorganic oxide film include tridecafluoro-1,1,2,2-tetrahydrooctyl trichlorosilane (FOTS), and 1H, 1H, 2H, 2H-perfluorodecyltrichlorosilane (FDTS). In a case where the silicon compound (FOTS, FDTS, or the like) which includes an —$SiCl_3$ terminal is introduced into a CVD reactor by water vapor, the silicon atoms from the —$SiCl_3$ group are thought to bond with the oxygen atoms from the —OH group in the inorganic oxide film.

In addition, as the straight-chain fluorine-containing silane coupling agent, it is possible to use a compound which is represented by $X_{3-n}R^7{}_nSi—R^6—Z$ (n=0, 1, 2). Here, X is any of a halogen, a methoxy group, an ethoxy group, an acetoxy group, or a 2-methoxyethoxy group, and $R^7$ is an alkyl group which has 1 to 3 carbon atoms, preferably a methyl group. $R^6$ is a $C_pH_{2p}$ group (p is a natural number of 1 to 20), or a group which includes a straight-chain fluorocarbon chain and $C_qH_{2q}$ (q is a natural number of 1 to 20), and Z is a group which includes any of a methyl group, a vinyl group, an amino group which may have a phenyl group or an alkylidene group, an epoxy group, a methacrylic group, an acrylic group, a mercapto group, an isocyanate group, an acylthio group, a ureido group, and a trifluoromethyl group.

Furthermore, it is possible to use a silane coupling agent sold by Gelest Inc., which is shown by the following formula, where a CF based group comes to the surface of the film to be able to bond with siloxane.

[Chem. 13]

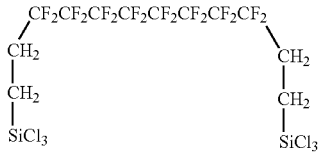

[Chem. 14]

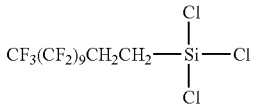

[Chem. 15]

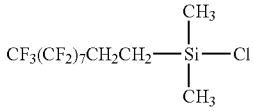

[Chem. 16]

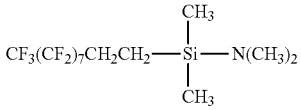

[Chem. 17]

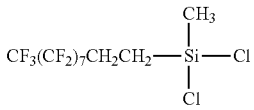

[Chem. 18]

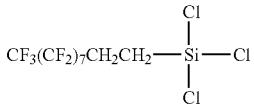

[Chem. 19]

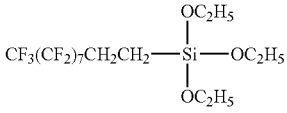

[Chem. 20]

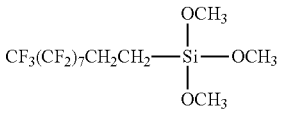

-continued

[Chem. 21]

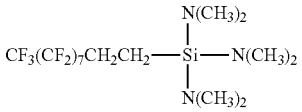

[Chem. 22]

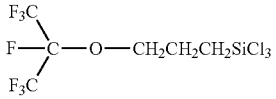

[Chem. 23]

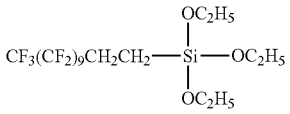

[Chem. 24]

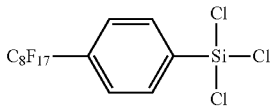

[Chem. 25]

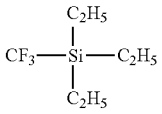

[Chem. 26]

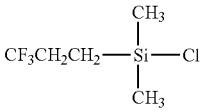

[Chem. 27]

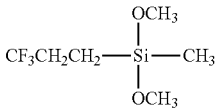

[Chem. 28]

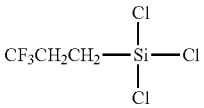

[Chem. 29]

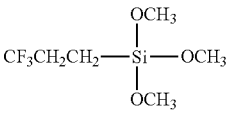

[Chem. 30]

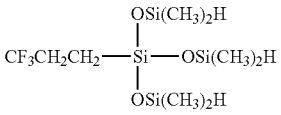

In addition, as the silicon compound for forming the second organic film, it is possible to use $CF_3(CF_2)_5(CH_2)_2Si(OCH_3)_3$: FHETMS, $CF_3(CF_2)_5(CH_2)_2Si(OCH_2CH_3)_3$: FHETES, $CF_3(CF_2)_7(CH_2)_2SiCl_3$: FOTCS, $CF_3(CF_2)_7(CH_2)_2Si(OCH_3)_3$: FOETMS, $CF_3(CF_2)_9O(CH_2)_3Si(OCH_2CH_3)_3$: FDOPTES, or the like.

Preferably, the second organic film is a self-assembled monolayer, that is, the second organic film may be a single molecular layer. The thickness of the second organic film is 0.5 nm to 30 nm, preferably 0.5 nm to 10 nm, and more preferably 0.5 nm to 5 nm.

In the present embodiment, the second organic film which has liquid repellency is formed. As the second organic film which has liquid repellency, it is possible to use, for example, a metal alkoxide based liquid-repellent film, a silicone-based liquid-repellent film, a fluorine-containing liquid-repellent film (commercially available examples of a fluorine-containing liquid-repellent film, such as the silane coupling agents sold by Gelest Inc., may be used as long as a CF based group is able to bond with siloxane and is arranged on the film surface), or the like which are formed by a dry process method such as a physical vapor deposition method (a vapor deposition method, a sputtering method, or the like) or a chemical vapor deposition method (a CVD method, an ALD method, or the like), by a sol-gel method, or by a wet process method such as a coating method.

Figure 2:
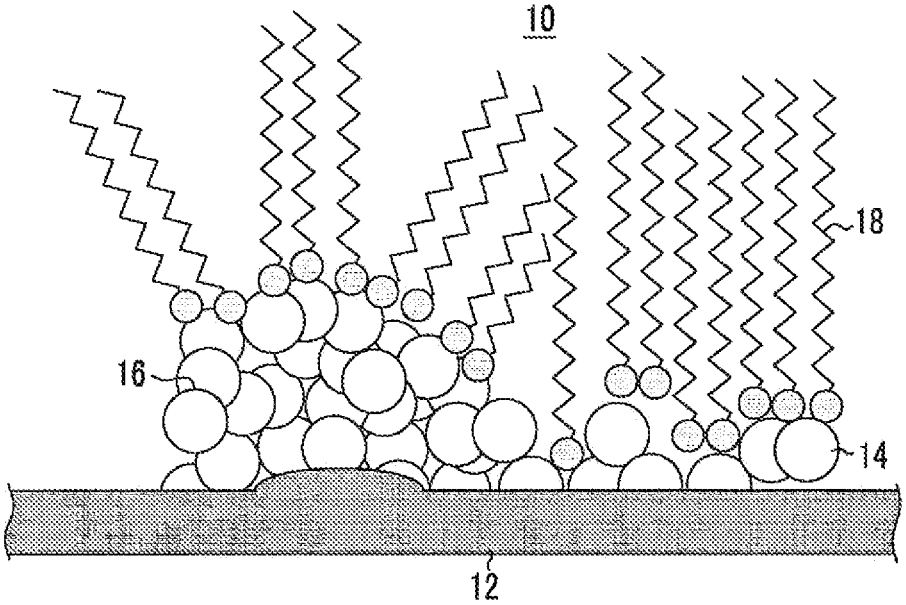
FIG. 2 is a schematic diagram which shows a structure of a water repellent film in the prior art.

Next, description will be given of the mechanism of the present invention. The present inventors carried out extensive research into the dynamic water repellency of water repellent films which include a straight-chain fluorine-containing silane coupling agent. Below, description will be given of the estimated mechanism of the present invention with reference to FIG. 2 and FIG. 3. FIG. 2 shows a structure of a water repellent film 10 of the prior art. An inorganic oxide film 14 which is configured by a silicon oxide film is formed on a silicon substrate 12. There are cases where an abnormal growth section 16 is generated in the growth stage of the inorganic oxide film 14 and the surface of the inorganic oxide film 14 is rough. The abnormal growth section 16 is generated in some cases due to the roughness or contamination of the surface of the silicon substrate 12, or in some cases due to a non-uniform gas flow of the raw material gas for forming the inorganic oxide film 14 in a gas phase method.

When forming an organic film 18 which includes a straight-chain fluorine-containing silane coupling agent on the inorganic oxide film 14 where the abnormal growth section 16 is generated, the terminal sections which should line up to be uniform on the outermost surface are disposed to be non-uniform as shown in FIG. 2. As a result, $CF_3$ which best exhibits the water repellency is not disposed to be uniform on the outermost surface, and the non-uniform portion exhibits hydrophilicity with regard to the $CF_3$. When there are a large number of such portions, it is considered that the dynamic water repellency is decreased because liquid droplets are trapped.

The structure of the water repellent film according to the present embodiment has a first organic film on the silicon substrate as shown in the flow of FIG. 1. By forming the first organic film which is more flexible than the inorganic oxide film which is configured by a silicon oxide film, smoothing of the inorganic oxide film is promoted by suppressing the generation of abnormal growth sections. As a result, since the terminal sections of the second organic film which has water repellency which is formed on the surface of the inorganic oxide film are disposed uniformly on the outermost surface, it is estimated that a high dynamic water repellency is exhibited.

Overall Configuration of Inkjet Recording Device

Next, as examples where a water repellent film which is formed by the water repellent film forming method of the present invention is applied, description will be given of a nozzle plate, an inkjet head which is provided with a nozzle plate, and an inkjet recording device. It is possible for the water repellent film forming method of the present invention to be preferably used with respect to a method of manufacturing a nozzle plate, a method of manufacturing an inkjet head, and a method of manufacturing an inkjet recording device.

Figure 3:
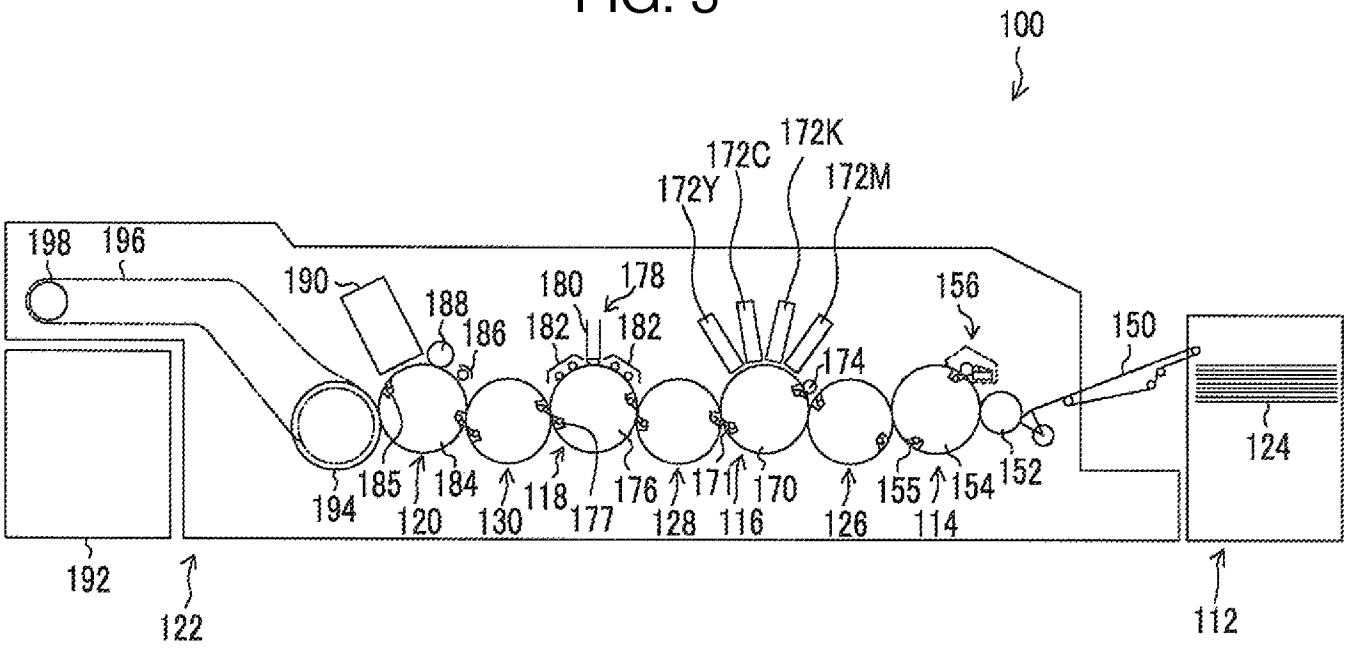
FIG. 3 is an overall configuration diagram which shows an outline of an inkjet recording device.

FIG. 3 is a configuration diagram of an inkjet recording device. An inkjet recording device 100 is a pressure cylinder direct drawing type inkjet recording device which forms desired color images by ejecting ink droplets of a plurality of colors from inkjet heads 172M, 172K, 172C, and 172Y onto a recording medium 124 (may be referred to as "paper" for convenience) which is held by a pressure cylinder (a drawing drum 170) of a drawing section 116, and is an on-demand type image forming device where a two liquid reaction (aggregation) system is applied which applies a processing liquid (here, an aggregation processing liquid) onto the recording medium 124 before ejecting the ink droplets and forms an image on the recording medium 124 due to the reaction of the processing liquid and the ink liquid.

As shown in the diagram, the inkjet recording device 100 is mainly configured by being provided with a paper feeding section 112, a processing liquid application section 114, the drawing section 116, a drying section 118, a fixing section 120, and a discharge section 122.

Paper Feeding Section

The paper feeding section 112 is a mechanism which supplies the recording medium 124 to the processing liquid application section 114, and the recording medium 124, which is sheets of paper, is stacked in the paper feeding section 112. A paper feeding tray 150 is provided in the paper feeding section 112 and the recording medium 124 is fed to the processing liquid application section 114 one sheet at a time from the paper feeding tray 150.

Processing Liquid Application Section

The processing liquid application section 114 is a mechanism which applies a processing liquid onto a recording surface of the recording medium 124. The processing liquid includes a coloring material aggregating agent which aggregates coloring materials (in the present example, pigments) in the ink which is applied to the drawing section 116, and the separation of the coloring materials and a solvent in the ink is promoted by the processing liquid and the ink coming into contact.

As shown in FIG. 3, the processing liquid application section 114 is provided with a paper feeding cylinder 152, a processing liquid drum 154, and a processing liquid coating device 156. The processing liquid drum 154 is a drum which holds, rotates, and transports the recording medium 124. The processing liquid drum 154 is provided with holding means (a gripper) 155 with a claw shape on the outer peripheral surface thereof, whereby it is possible to hold the leading end of the recording medium 124 by interposing the recording medium 124 between the claw of the holding means 155 and the peripheral surface of the processing liquid drum 154.

The processing liquid coating device 156 is provided to oppose the peripheral surface of the processing liquid drum 154 outside the processing liquid drum 154. The processing liquid coating device 156 is configured by a processing liquid container where the processing liquid is stored, an annex roller where a part is immersed in the processing liquid of the processing liquid container, and a rubber roller which transfers the processing liquid after measuring onto the recording medium 124 by being pressed to the annex roller and the recording medium 124 on the processing liquid drum 154. According to this processing liquid coating device 156, it is possible to coat the processing liquid onto the recording medium 124 while performing measurement.

The recording medium 124 to which the processing liquid is applied by the processing liquid application section 114 is passed across from the processing liquid drum 154 to the drawing drum 170 of the drawing section 116 via an intermediate transporting section 126.

Drawing Section

The drawing section 116 is provided with a drawing drum (a second transporting body) 170, a paper pressing roller 174, and inkjet heads 172M, 172K, 172C, and 172Y. In the same manner as the processing liquid drum 154, the drawing drum 170 is provided with holding means (a gripper) 171 with a claw shape on the outer peripheral surface thereof. The recording medium 124 which is fixed on the drawing drum 170 is transported such that the recording surface faces to the outside and inks are applied to the recording surface from the inkjet heads 172M, 172K, 172C, and 172Y.

It is preferable that the inkjet heads 172M, 172K, 172C, and 172Y each be set as full line inkjet recording heads (inkjet heads) which have lengths corresponding to the maximum width of an image forming region in the recording medium 124. Nozzle rows where a plurality of nozzles for discharging ink are disposed across the entire width of the image forming region are formed in the ink discharging surface. Each of the inkjet heads 172M, 172K, 172C, and 172Y is disposed so as to extend in a direction which is orthogonal to the transport direction (the rotation direction of the drawing drum 170) of the recording medium 124.

By liquid droplets of corresponding colored inks being ejected from each of the inkjet heads 172M, 172K, 172C, and 172Y toward the recording surface of the recording medium 124 which is adhered to and held on the drawing drum 170, the ink comes into contact with the processing liquid which was applied to the recording surface in advance by the processing liquid application section 114 and a coloring material aggregate is formed by the aggregation of the coloring materials (the pigments) which are dispersed in the inks. Due to this, the coloring materials are prevented from flowing or the like on the recording medium 124, and an image is formed on the recording surface of the recording medium 124.

The recording medium 124 where the image is formed in the drawing section 116 is passed across to a drying drum 176 of the drying section 118 from the drawing drum 170 via an intermediate transporting section 128.

Drying Section

The drying section 118 is a mechanism which dries moisture which is included in the solvent which is separated by the coloring material aggregation operation, and is provided with the drying drum 176 and the solvent drying device 178 as shown in FIG. 3.

In the same manner as the processing liquid drum 154, the drying drum 176 is provided with holding means (a gripper) 177 with a claw shape on the outer peripheral surface thereof, and it is possible for the holding means 177 to hold the leading end of the recording medium 124.

The solvent drying device 178 is arranged at a position which opposes the outer peripheral surface of the drying drum 176 and is configured by a plurality of halogen heaters 180 and warm air blowing nozzles 182 which are each arranged between each of the halogen heaters 180.

The recording medium 124 where the drying process is performed by the drying section 118 is passed across to a fixing drum 184 of the fixing section 120 from the drying drum 176 via an intermediate transporting section 130.

Fixing Section

The fixing section 120 is configured by the fixing drum 184, a halogen heater 186, a fixing roller 188, and an in-line sensor 190. In the same manner as the processing liquid drum 154, the fixing drum 184 is provided with holding means (a gripper) 185 with a claw shape on the outer peripheral surface thereof, and it is possible for the holding means 185 to hold the leading end of the recording medium 124.

Due to the rotation of the fixing drum 184, the recording medium 124 is transported such that the recording surface faces to the outside, whereby pre-heating is performed by the halogen heater 186, a fixing process is performed by the fixing roller 188, and inspection is performed by the in-line sensor 190 with regard to the recording surface.

According to the fixing section 120, since thermoplastic resin fine particles inside the thin image layer which is formed by the drying section 118 are melted by being heated and pressured by the fixing roller 188, it is possible to securely fix the particles to the recording medium 124. In addition, by setting the surface temperature of the fixing drum 184 to 50° C. or more, drying is promoted by heating the recording medium 124, which is held on the outer peripheral surface of the fixing drum 184, from the rear surface, and it is possible to prevent destruction of the image during the fixing, and it is possible to increase the image intensity due to the effects of increasing the image temperature.

In addition, in a case where a UV-curable monomer is contained in the ink, by irradiating UV to the image in a fixing section which is provided with a UV irradiation lamp after the moisture is sufficiently evaporated in the drying section, it is possible to improve the image intensity due to the curing polymerization of the UV-curable monomer.

Discharge Section

As shown in FIG. 3, the discharge section 122 is provided after the fixing section 120. The discharge section 122 is provided with a discharge tray 192, and a transfer cylinder 194, a transport belt 196, and a tension roller 198 are provided between the discharge tray 192 and the fixing drum 184 of the fixing section 120 so as to come into contact therewith. The recording medium 124 is sent to the transport belt 196 by the transfer cylinder 194, and discharged to the discharge tray 192.

In addition, although not shown in the diagram, in addition to the configuration described above, the inkjet recording device 100 of the present example is provided with an ink storage/loading section which supplies ink to each of the inkjet heads 172M, 172K, 172C, and 172Y, and means which supplies the processing liquid with regard to the processing liquid application section 114, and also provided with a head maintenance section which performs cleaning (wiping the nozzle surfaces, purging, nozzle suctioning, and the like) of each of the inkjet heads 172M, 172K, 172C, and 172Y, a position detecting sensor which detects the position of the recording medium 124 on the paper transport path, a temperature sensor which detects the temperature of each section of the device, and the like.

Here, description was given of the drum transport type inkjet recording device in FIG. 3; however, the present invention is not limited thereto, and it is possible to use the present invention even in a belt transport type inkjet recording device, or the like.

Structure of Inkjet Head

Next, description will be given of the structure of the inkjet heads 172M, 172K, 172C, and 172Y. Here, since the structures of each of the inkjet heads 172M, 172K, 172C, and 172Y are common to each other, below, the heads are indicated by the reference numeral 250, which represents all of the heads.

Figure 4A:
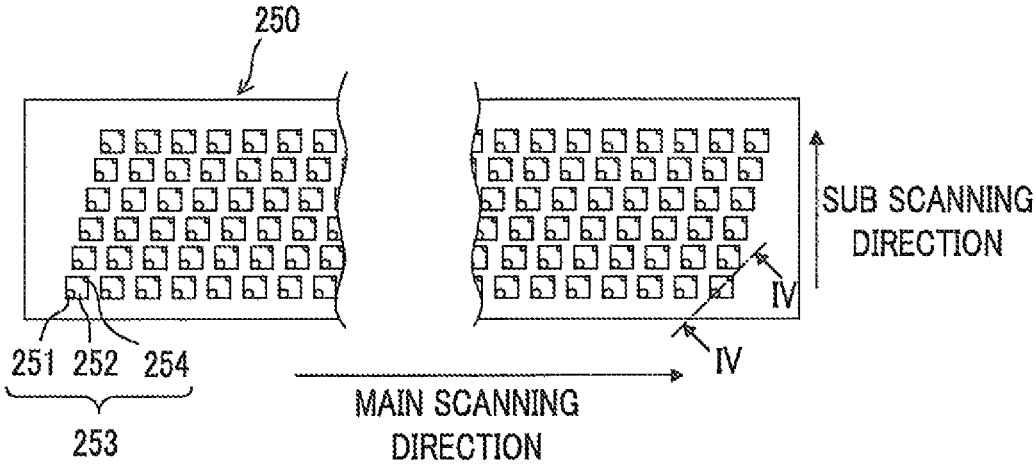
FIGS. 4A and 4B are perspective planar diagrams which show a structure example of an inkjet head.
Figure 4B:
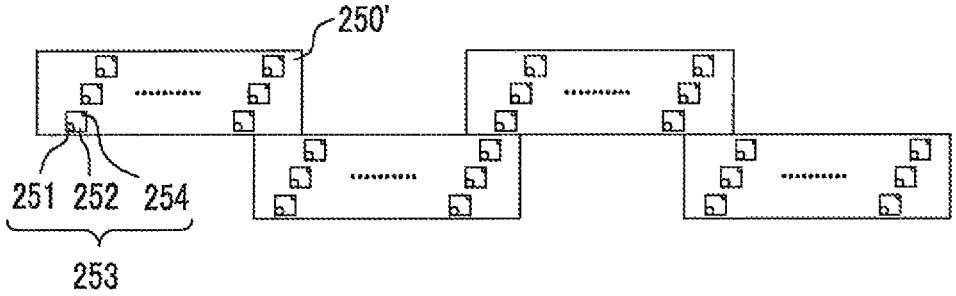
Figure 5:
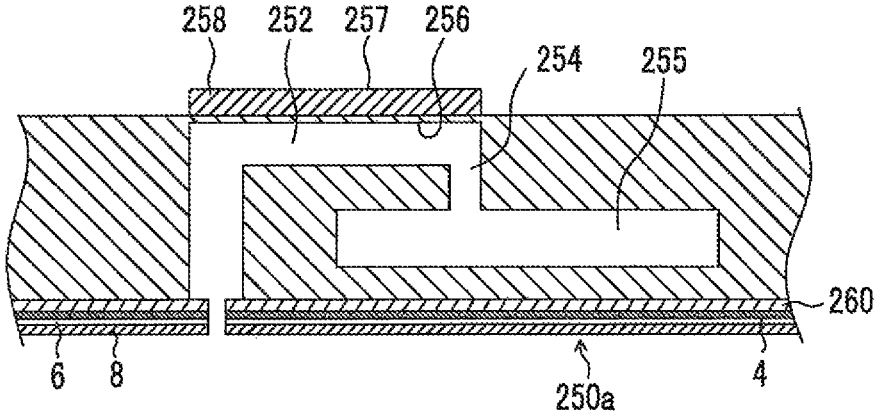
FIG. 5 is a cross sectional diagram taken along line IV-IV in FIG. 4A.

FIG. 4A is a perspective planar diagram which shows a structure example of an inkjet head 250 and FIG. 4B is a perspective planar diagram which shows another structure example of the inkjet head 250. FIG. 5 is a cross sectional diagram (a cross sectional diagram taken along the line IV-IV in FIG. 4A) which shows a three-dimensional configuration of an ink chamber unit.

In order to increase the density of the dot pitch, which is formed on the recording paper surface, it is necessary to increase the density of the nozzle pitch in the inkjet head 250. As shown in FIG. 4A, the inkjet head 250 of the present example has a structure where nozzles 251, which are holes for discharging ink droplets, and a plurality of ink chamber units 253 formed of pressure chambers 252 and the like, which correspond to each of the nozzles 251, are disposed to be staggered (two-dimensionally arranged) in the form of a matrix. Due to this, an increase is achieved in the density of the substantive intervals between the nozzles (the projecting nozzle pitches) which project so as to line up along the longitudinal direction of the head (the main scanning direction which is orthogonal to the paper transport direction).

An aspect where one or more nozzle rows are configured across a length which corresponds to the total width of the recording medium 124 in a direction which is substantially orthogonal to the paper transport direction is not limited to the present example. For example, instead of the configuration of FIG. 4A, as shown in FIG. 4B, a line head which has a nozzle row with a length which corresponds to the total width of the recording medium 124 may be configured by disposing thin rectangular head blocks (head tips) 250' where a plurality of the nozzles 251 are disposed two-dimensionally in a staggered shape and linking the head blocks 250'. In addition, although omitted from the diagrams, a line head may be configured by lining up the thin rectangular heads in one row.

As shown in FIG. 5, each of the nozzles 251 is formed in a nozzle plate 260 which configures the ink discharging surface 250*a* of the inkjet head 250. The nozzle plate 260 is configured by a silicon substrate.

A first organic film 4, an inorganic oxide film 6, and a second organic film 8 are formed on the surface of the nozzle plate 260 (the surface of the ink discharging side). The second organic film 8 has liquid repellency with respect to ink, which prevents the attachment of ink. In particular, in the present embodiment, the dynamic water repellency of the second organic film 8 is improved by the first organic film 4.

The pressure chambers 252 which are provided to correspond to each of the nozzles 251 have a planar shape which is substantially a square, and the nozzles 251 and supply ports 254 are provided at both corner sections on a diagonal line. Each of the pressure chambers 252 is linked with a common flow passage 255 via the supply ports 254. The common flow passage 255 is linked with an ink supply tank (not shown in the diagram) which is an ink supply source, and the ink (the liquid) which is supplied from the ink supply tank is distributed and supplied to each of the pressure chambers 252 via the common flow passage 255.

A piezoelectric element 258 which is provided with an individual electrode 257 is bonded with a diaphragm 256 which configures the top surface of the pressure chambers 252 and which is used along with a common electrode, and the ink (the liquid) is discharged from the nozzles 251 by the piezoelectric element 258 changing shape due to the application of a driving voltage (a driving signal) to the individual electrode 257. When the ink is discharged, new ink is supplied to the pressure chambers 252 by passing through the supply ports 254 from the common flow passage 255.

Here, the arrangement structure of the nozzles is not limited to the illustrated example, and it is possible to apply various nozzle arrangement structures such as an arrangement structure which has one nozzle row in the sub-scanning direction.

In addition, without being limited to a printing system using a line type head, a serial system may be applied where printing is performed in the width direction by scanning the thin rectangular head, which is smaller than the length of the paper in the width direction (the main scanning direction), in the width direction of the paper, printing is performed in the width direction of the paper in the next printing region by moving the paper a predetermined amount only in a direction (the sub-scanning direction) which intersects with the width direction when one cycle of printing in the width direction is finished, and printing is performed across the entire surface of the printing region of the paper by repeating these operations.

Example 1

Below, further specific description will be given of the present invention using examples of the present invention. Here, it is possible for the materials, the usage amounts, the ratios, the contents of the processes, the processing procedures, and the like which are shown in the following examples to be appropriately changed without departing from the scope of the present invention. Accordingly, the range of the present invention should not be interpreted as being limited by the specific examples which are shown below.

Samples 1-8

Sample 1 was provided with a silicon substrate, a silicon oxide film which is formed on the silicon substrate, and an organic film which is formed on the silicon oxide film with FDTS (1H,1H,2H,2H-heptadecafluorodecyl silane) which is a straight-chain fluorine-containing silane coupling agent as a raw material. The silicon oxide film and the organic film were formed with a CVD method.

Samples 2-8 were provided with a silicon substrate, a first organic film which is formed on the silicon substrate, a silicon oxide film which is formed on the first organic film, and a second organic film which is formed on the silicon oxide film with FDTS which is a straight-chain fluorine-containing silane coupling agent as a raw material. Samples 2-8 were provided with first organic films which were each formed of different raw materials. The first organic film, the silicon oxide film, and the second organic film were formed with a CVD method.

Sample 2 was provided with a first organic film with APTES ((3-aminopropyl)triethoxysilane) as a raw material, Sample 3 was provided with a first organic film with AHAPS (n-(6-aminohexyl)aminopropyl trimethoxysilane) as a raw material, Sample 4 was provided with a first organic film with AEAPDMS (N-(2-aminoethyl)-3-aminopropyl methyldimethyoxysilane) as a raw material, Sample 5 was provided with a first organic film with ODTMS (n-octadecyltrimethoxysilane) as a raw material, Sample 6 was provided with a first organic film with ODTES (n-octadecyltriethoxysilane) as a raw material, Sample 7 was provided with a first organic film with OCTMS (n-octyltrimethoxysilane) as a raw material, and Sample 8 was provided with a first organic film with HMDS (1,1,1,3,3,3-hexamethyldisilazane) as a raw material.

Evaluation Method

The dynamic water repellency relating to Samples 1-8 was evaluated using a sliding down method. As the testing device, a contact angle meter (DM-701) manufactured by Kyowa Interface Science Co., Ltd. was used. As the evaluation conditions, pure water was used as the liquid droplets under a room temperature atmosphere. In a case where an end section of the liquid droplets which comes into contact with the silicon substrate moved 1 mm or more when the silicon substrate was inclined (at angles of 90° and 60°), it was determined that the liquid droplets slid down, and the angle of the silicon substrate at this time was the sliding down angle.

Evaluation

Table 1 displays the presence or absence of the first organic film, the type of raw material, and the results of the sliding down at an angle of 90° (sliding down 1 of liquid droplets) and an angle of 60° (sliding down 2 of liquid droplets). A case where the liquid droplets slid down is indicated by G, and a case where there was no sliding down is indicated by NG.

As seen from these results, it was possible to confirm sliding down of liquid droplets in Samples 2-8 which were provided with the first organic film. It was possible to confirm an improvement in the dynamic water repellency in Samples 2-8 in comparison with Sample 1 which was not provided with the first organic film. In particular, it was possible to confirm sliding down even at 60° in Samples 2-4, and it was possible to confirm that the dynamic water repellency was greatly improved in comparison with Sample 1.

TABLE 1

| | Sample | | | | | | | |
|---|---|---|---|---|---|---|---|---|
| | 1 | 2 | 3 | 4 | 5 | 6 | 7 | 8 |
| First organic film | None | APTES | AHAPS | AEAPDMS | ODTMS | ODTES | OCTMS | HDMS |
| Sliding down 1 of liquid droplets | NG | G | G | G | G | G | G | G |
| Sliding down 2 of liquid droplets | NG | G | G | G | NG | NG | NG | NG |

What is claimed is:

1. A method of manufacturing a water repellent film comprising:

forming a first organic film on a silicon substrate by using a silicon compound represented by $X_{3-n}R^2_nSi—R^1—Z$ (n=0, 1, 2) which does not include a fluorine atom or a silicon compound represented by $HN(SiR^3R^4R^5)_2$, as a raw material;

forming an inorganic oxide film on the first organic film; and forming a second organic film on the inorganic oxide film by using a straight-chain fluorine-containing silane coupling agent as a raw material:

wherein, X in the formula is any of a halogen (except fluorine), a methoxy group, an ethoxy group, an acetoxy group, or a 2-methoxyethoxy group, $R^2$ is an alkyl group which has 1 to 3 carbon atoms, $R^1$ is $C_mH_{2m}$ wherein m is a natural number of 1 to 20, Z is a group which contains any of a methyl group, a vinyl group, an amino group, an epoxy group, a methacrylic group, an acrylic group, a mercapto group, an isocyanate group, an acylthio group, or a ureido group, and $R^3$, $R^4$, and $R^5$ are alkyl groups which have 1 to 3 carbon atoms.

2. The method of manufacturing a water repellent film according to claim 1, wherein the silicon compound has a boiling point of 20° C. to 350° C.

3. The method of manufacturing a water repellent film according to claim 2, wherein the straight-chain fluorine-containing silane coupling agent is a compound which is represented by $X_{3-n}R^7_nSi—R^6—Z$ (n=0, 1, 2):

wherein, X in the formula is any of a halogen, a methoxy group, an ethoxy group, an acetoxy group, or a 2-methoxyethoxy group, $R^7$ is an alkyl group which has 1 to 3 carbon atoms, $R^6$ is a $C_pH_{2p}$ group wherein p is a natural number of 1 to 20, or a group which includes a straight-chain fluorocarbon chain and $C_qH_{2q}$ wherein q is a natural number of 1 to 20, and Z is a group which includes any of a methyl group, a vinyl group, an amino group, an epoxy group, a methacrylic group, an acrylic group, a mercapto group, an isocyanate group, an acylthio group, a ureido group, and a trifluoromethyl group.

4. The method of manufacturing a water repellent film according to claim 3, wherein at least one of the first organic film and the second organic film is a self-assembled monolayer.

5. The method of manufacturing a water repellent film according to claim 3, wherein, in the forming of the first organic film, the first organic film is formed by a gas phase method.

6. The method of manufacturing a water repellent film according to claim 5, wherein, in the forming of the second organic film, the second organic film is formed by a gas phase method.

7. The method of manufacturing a water repellent film according to claim 1, wherein the straight-chain fluorine-containing silane coupling agent is a compound which is represented by $X_{3-n}R^7_nSi—R^6—Z$ (n=0, 1, 2):

wherein, X in the formula is any of a halogen, a methoxy group, an ethoxy group, an acetoxy group, or a 2-methoxyethoxy group, $R^7$ is an alkyl group which has 1 to 3 carbon atoms, $R^6$ is a $C_pH_{2p}$ group wherein p is a natural number of 1 to 20, or a group which includes a straight-chain fluorocarbon chain and $C_qH_{2q}$ wherein q is a natural number of 1 to 20, and Z is a group which includes any of a methyl group, a vinyl group, an amino group, an epoxy group, a methacrylic group, an acrylic group, a mercapto group, an isocyanate group, an acylthio group, a ureido group, and a trifluoromethyl group.

8. The method of manufacturing a water repellent film according to claim 1, wherein at least one of the first organic film and the second organic film is a self-assembled monolayer.

9. The method of manufacturing a water repellent film according to claim 1, wherein, in the forming of the first organic film, the first organic film is formed by a gas phase method.

10. The method of manufacturing a water repellent film according to claim 1, wherein the inorganic oxide film is a silicon oxide film.

11. The method of manufacturing a water repellent film according to claim 10, wherein, in the forming of the inorganic oxide film, the inorganic oxide film is formed by a gas phase method.

12. The method of manufacturing a water repellent film according to claim 1, wherein, in the forming of the inorganic oxide film, the inorganic oxide film is formed by a gas phase method.

13. The method of manufacturing a water repellent film according to claim 1, wherein, in the forming of the second organic film, the second organic film is formed by a gas phase method.

14. A nozzle plate comprising:

a silicon substrate where nozzles are formed;

a first organic film which is formed on the silicon substrate and which does not include fluorine atoms;

an inorganic oxide film which is formed on the first organic film; and a second organic film which is formed on the inorganic oxide film and of which a raw material is a straight-chain fluorine-containing silane coupling agent, wherein in a case where pure water is applied onto the second organic film and the silicon substrate is inclined, an end section where the pure water and the second organic film come into contact moves 1 mm or more with the angle of the silicon substrate at 90°.

15. An inkjet head comprising:

the nozzle plate according to claim 14;

a pressure chamber which is linked with the nozzle; and a piezoelectric element which pressurizes a liquid inside the pressure chamber according to a driving signal.

16. An inkjet recording device comprising:

the inkjet head according to claim 15.

17. A nozzle plate comprising:

a silicon substrate where nozzles are formed;

a first organic film which is formed on the silicon substrate and which does not include fluorine atoms;

an inorganic oxide film which is formed on the first organic film; and a second organic film which is formed on the inorganic oxide film and of which a raw material is a straight-chain fluorine-containing silane coupling agent, wherein in a case where pure water is applied onto the second organic film and the silicon substrate is inclined, an end section where the pure water and the second organic film come into contact moves 1 mm or more with the angle of the silicon substrate at 60°.

18. An inkjet head comprising:

the nozzle plate according to claim 17;

a pressure chamber which is linked with the nozzle; and a piezoelectric element which pressurizes a liquid inside the pressure chamber according to a driving signal.

19. An inkjet recording device comprising:

the inkjet head according to claim 18.

* * * * *